US010760362B2

(12) United States Patent
Bellicard et al.

(10) Patent No.: US 10,760,362 B2
(45) Date of Patent: Sep. 1, 2020

(54) SYSTEMS AND METHODS FOR A RELEASE DEVICE

(71) Applicant: Schlumberger Technology Corporation, Sugar Land, TX (US)

(72) Inventors: Claire Bellicard, Houston, TX (US); Stephanie Elstrop, Houston, TX (US); Caroline Stephan Rivas, Houston, TX (US); Todor Sheiretov, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/830,132

(22) Filed: Dec. 4, 2017

(65) Prior Publication Data

US 2019/0169947 A1 Jun. 6, 2019

(51) Int. Cl.

| | |
|---|---|
| ***E21B 23/00*** | (2006.01) |
| ***E21B 17/02*** | (2006.01) |
| *E21B 49/00* | (2006.01) |

(52) U.S. Cl.

CPC ..... *E21B 23/00* (2013.01); *E21B 17/028* (2013.01); *E21B 49/00* (2013.01)

(58) Field of Classification Search

CPC combination set(s) only.
See application file for complete search history.

(56) References Cited

U.S. PATENT DOCUMENTS 3,327,784 A 6/1967 Pardue
3,517,740 A 6/1970 Johnson
4,275,786 A 6/1981 Lee
4,651,837 A * 3/1987 Mayfield ..... E21B 10/66 175/260
4,874,326 A * 10/1989 Marolda, Jr. ..... H01R 13/523 439/273

(Continued)

FOREIGN PATENT DOCUMENTS

| | | |
|---|---|---|
| EP | 2381063 A2 | 10/2011 |
| WO | WO2004046497 A1 | 6/2004 |
| WO | WO2008125108 A1 | 10/2008 |

OTHER PUBLICATIONS

International Search Report and Written Opinion issued in the corresponding PCT application PCT/US2018/063713, dated Feb. 22, 2019 (16 pages).

*Primary Examiner* — Taras P Bemko
*Assistant Examiner* — Ronald R Runyan
(74) *Attorney, Agent, or Firm* — Eileen Pape

(57) ABSTRACT

A system includes a downhole tool having multiple electric leads. The system also includes a release device that includes an outer shell configured to mechanically couple to the downhole tool, and the outer shell is configured to form a cavity that is fluidly separate from wellbore fluids contained within a wellbore while the outer shell is mechanically coupled to the downhole tool. The release device also includes a contact block configured to electrically couple to the multiple electric leads. In addition, the contact block is configured to electrically decouple from the multiple electric leads while the outer shell remains mechanically coupled to the downhole tool. Further, the contact block is configured to remain in the cavity after electrically decoupling from the plurality of electric leads.

15 Claims, 5 Drawing Sheets

(56) References Cited

U.S. PATENT DOCUMENTS

| | | | | |
|---|---|---|---|---|
| 6,032,733 | A | 3/2000 | Ludwig et al. | |
| 6,431,269 | B1 | 8/2002 | Post et al. | |
| 7,407,007 | B2 | 8/2008 | Tibbles | |
| 7,588,084 | B2 | 9/2009 | Hallundbaek | |
| 2002/0170720 | A1* | 11/2002 | Haugen | E21B 19/00 166/379 |
| 2006/0278388 | A1 | 12/2006 | Zanca et al. | |
| 2011/0259601 | A1 | 10/2011 | Withers | |
| 2015/0047854 | A1 | 2/2015 | Hradecky et al. | |
| 2015/0340803 | A1 | 11/2015 | Li et al. | |
| 2016/0359262 | A1 | 12/2016 | Kenison et al. | |
| 2017/0328137 | A1 | 11/2017 | Perry et al. | |

* cited by examiner

SYSTEMS AND METHODS FOR A RELEASE DEVICE

BACKGROUND

This disclosure relates to systems and methods to release a downhole device in a wellbore, which may enable other downhole devices to continue receiving power.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, these statements are to be read in this light, and not as admissions of any kind.

To locate and extract resources from a well, a wellbore may be drilled into a geological formation. Downhole devices, such as toolstrings and sensors, may be placed into the wellbore to obtain measurements relating to the wellbore. In some cases, several downhole devices may be connected in a string of downhole devices connected to each other. The string of downhole devices may receive electrical power from upstream power sources at the surface or from a battery located in another downhole device. Multiple electrical leads, which may include wires or other conductors, may provide the electrical power to each of the downhole devices.

In some situations, one of the downhole devices may be released into the wellbore, causing that downhole device to become mechanically and electrically decoupled from the string of downhole devices. When this happens, the electrical leads between the released downhole device and the remaining string of downhole devices may become exposed to fluid present in the wellbore, which may short electrical leads still receiving electricity. This may effectively deactivate not just the downhole device that was released, but also the remaining string of downhole devices that were not released.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a system includes a downhole tool having multiple electric leads. The system also includes a release device that includes an outer shell configured to mechanically couple to the downhole tool, and the outer shell is configured to form a cavity that is fluidly separate from wellbore fluids contained within a wellbore while the outer shell is mechanically coupled to the downhole tool. The release device also includes a contact block configured to electrically couple to the multiple electric leads. In addition, the contact block is configured to electrically decouple from the multiple electric leads while the outer shell remains mechanically coupled to the downhole tool. Further, the contact block is configured to remain in the cavity after electrically decoupling from the plurality of electric leads.

In another example, a method includes electrically decoupling a contact block of a release device from multiple electric leads of a downhole tool while maintaining a fluid separation between the contact block and wellbore fluids contained within a wellbore. The method also includes mechanically decoupling an outer shell of the release device after electrically decoupling the contact block from the multiple electric leads.

In yet another example, a system includes a first downhole tool having a first multiple electric leads and a first release device that includes a first outer shell configured to mechanically couple to the first downhole tool. Further, the first outer shell is configured to form a first cavity that is fluidly separate from wellbore fluids contained within a wellbore while the first outer shell is mechanically coupled to the first downhole tool. The first release device also includes a first contact block configured to electrically couple to the first multiple electric leads. Moreover, the first contact block is configured to electrically decouple from the first multiple electric leads while the first outer shell remains mechanically coupled to the first downhole tool. In addition, the first contact block is configured to remain in the first cavity after electrically decoupling from the first multiple of electric leads. The system also includes a second downhole tool having a second multiple of electric leads and a second release device that includes a second outer shell configured to mechanically couple to the second downhole tool. Further, the second outer shell is configured to form a second cavity that is fluidly separate from wellbore fluids contained within the wellbore while the second outer shell is mechanically coupled to the second downhole tool. In addition, the second release device includes a second contact block configured to electrically couple to the second multiple of electric leads. Moreover, the second contact block is configured to electrically decouple from the second multiple of electric leads while the second outer shell remains mechanically coupled to the second downhole tool. Further, the second contact block is configured to remain in the second cavity after electrically decoupling from the second multiple of electric leads.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to devices that improve the ability to release downhole tools in a wellbore while maintaining a flow of electricity to other downhole tools in a wellbore. Toolstrings containing downhole tools may be placed into the wellbore to gather information about the geological formation. Multiple electrical leads (e.g., wires, conductors, etc.) may be coupled to each of the downhole tools to provide power to the downhole tools. In some situations during an operation within the wellbore, one of the downhole tools may be released into the wellbore. It is desirable to release a downhole tool while maintaining a flow of electricity to other downhole tools that are not released.

Accordingly, embodiments of this disclosure relate to systems and methods for releasing a downhole tool with multiple electrical leads. That is, some embodiments include a release device coupled to a downhole tool and multiple electrical leads that provide power to one or more downhole tools. The release device may be able to decouple the electrical leads from the downhole tool before mechanically decoupling from the downhole tool. Decoupling the electrical leads first may enable electricity to continue to flow to other downhole tools upstream of the downhole tool being decoupled.

Figure 1:
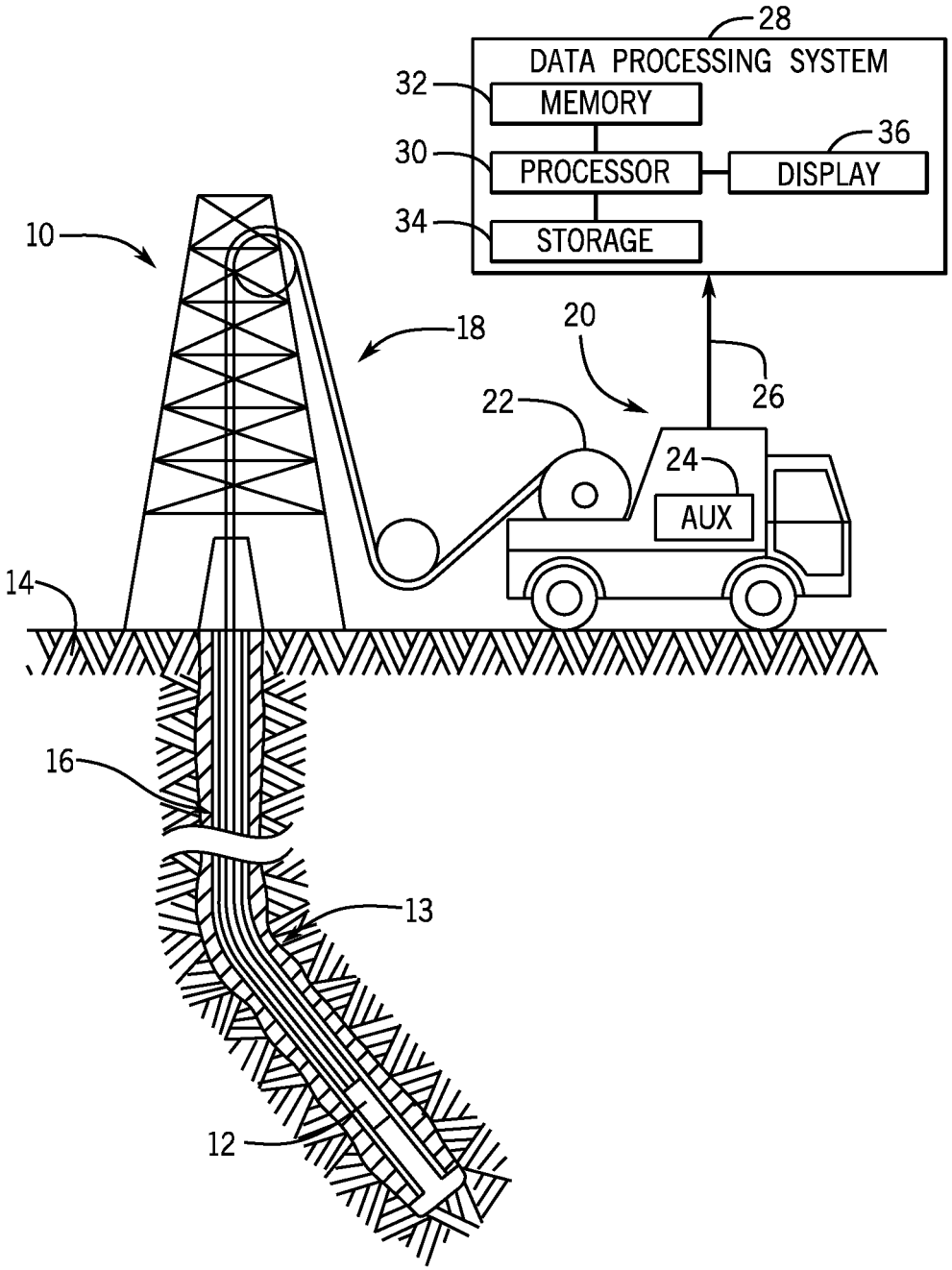
FIG. 1 is a schematic diagram of a wireline system that includes a toolstring to detect properties of a wellbore or geological formation adjacent to the toolstring, in accordance with an aspect of the present disclosure.

With this in mind, FIG. 1 illustrates a well-logging system 10 that may employ the systems and methods of this disclosure. The well-logging system 10 may be used to convey a toolstring 12 through a geological formation 14 via a wellbore 16. Further, the wellbore 16 may not continue straight down into the geological formation 14, and the wellbore 16 may contain a turn 13. The wellbore 16 may continue past the turn into the geological formation 14 at an angle as high as ninety degrees. In the example of FIG. 1, the toolstring 12 is conveyed on a cable 18 via a logging winch system (e.g., vehicle) 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20, the cable 18, and/or the toolstring 12.

Moreover, while the toolstring 12 is described as a wireline toolstring, it should be appreciated that any suitable conveyance may be used. For example, the toolstring 12 may instead be conveyed on a slickline or via coiled tubing, as part of a pump down perforation application, as part of a tough logging conditions (TLC) operation, as part of a tubing-conveyed perforating (TCP) operation, or as a logging-while-drilling (LWD) tool as part of a bottom hole assembly (BHA) of a drill string, and so forth. For the purposes of this disclosure, the toolstring 12 may include any suitable tool that utilizes electricity, such as a sensor to obtain measurements of properties of the geological formation 14, a drilling tool, a material collection tool, tractor tool, etc. The toolstring 12 may include multiple downhole tools, such as 2, 3, 4, 5, 6, or more downhole tools to conduct operations in the wellbore 16.

The toolstring 12 may emit energy into the geological formation 14, which may enable measurements to be obtained by the toolstring 12 as data 26 relating to the wellbore 16 and/or the geological formation 14. The data 26 may be sent to a data processing system 28. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display the images generated by the processor 30. The data processing system 28 may be a local component of the logging winch system 20 (e.g., within the toolstring 12), a remote device that analyzes data from other logging winch systems 20, a device located proximate to the drilling operation, or any combination thereof. In some embodiments, the data processing system 28 may be a mobile computing device (e.g., tablet, smart phone, or laptop) or a server remote from the logging winch system 20.

Figure 2:
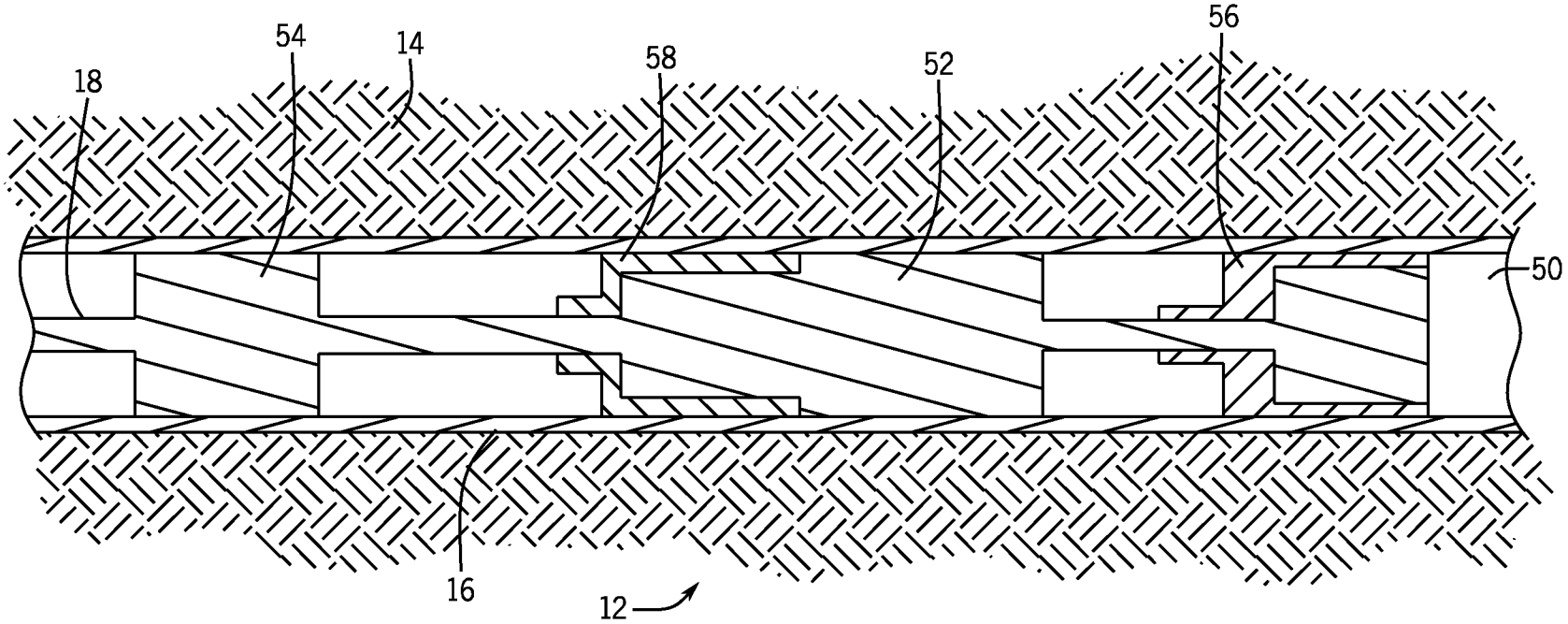
FIG. 2 illustrates an embodiment of the toolstring of FIG. 1 with a first downhole tool, a second downhole tool, a third downhole tool, a first release device coupled to the first downhole tool, and a second release device coupled to the second downhole tool.

FIG. 2 illustrates an embodiment of the toolstring 12 having a first downhole tool 50, a second downhole tool 52, a third downhole tool 54, a first release device 56 coupled to the first downhole tool 50, and a second release device 58 coupled to the second downhole tool 52. The toolstring 12 may descend into the wellbore 16 to perform various operations (e.g., data gathering, sample collection, drilling, etc.). The cable 18 may be used to provide power to the first downhole tool 50, the second downhole tool 52, the third downhole tool 54, the first release device 56, and the second release device 58. In some embodiments, a battery may be used to provide power. Multiple electrical leads may be used to provide power to the downhole tools 50, 52, 54. In some operations, it may be beneficial to release one or more of the downhole tools 50, 52, 54 into the wellbore 16 due to foreseen or unforeseen circumstances, such as one of the downhole tools 50, 52, 54 getting stuck in the wellbore 16. Accordingly, one of the release devices 56, 58 may be used to decouple the respective downhole tool while maintaining the electrical connections of downhole tools upstream of the release device. Maintaining the electrical connections of upstream downhole tools may enable the upstream downhole tools to continue being fully operational, which facilitates further operation of the toolstring 12 (e.g., retracting the toolstring 12 to the surface).

The present embodiment includes two release devices 56, 58, which provides more flexibility to an operator on the surface. For example, if the second downhole tool 52 is stuck, causing the toolstring 12 to be stuck, utilizing the first release device 56 to decouple the first downhole tool 50 is unlikely to affect the second downhole tool 52. As such, the second release device 58 may be used to decouple the second downhole tool 52 from the toolstring 12, thereby enabling the toolstring 12 to move freely within the wellbore 16.

Figure 3:
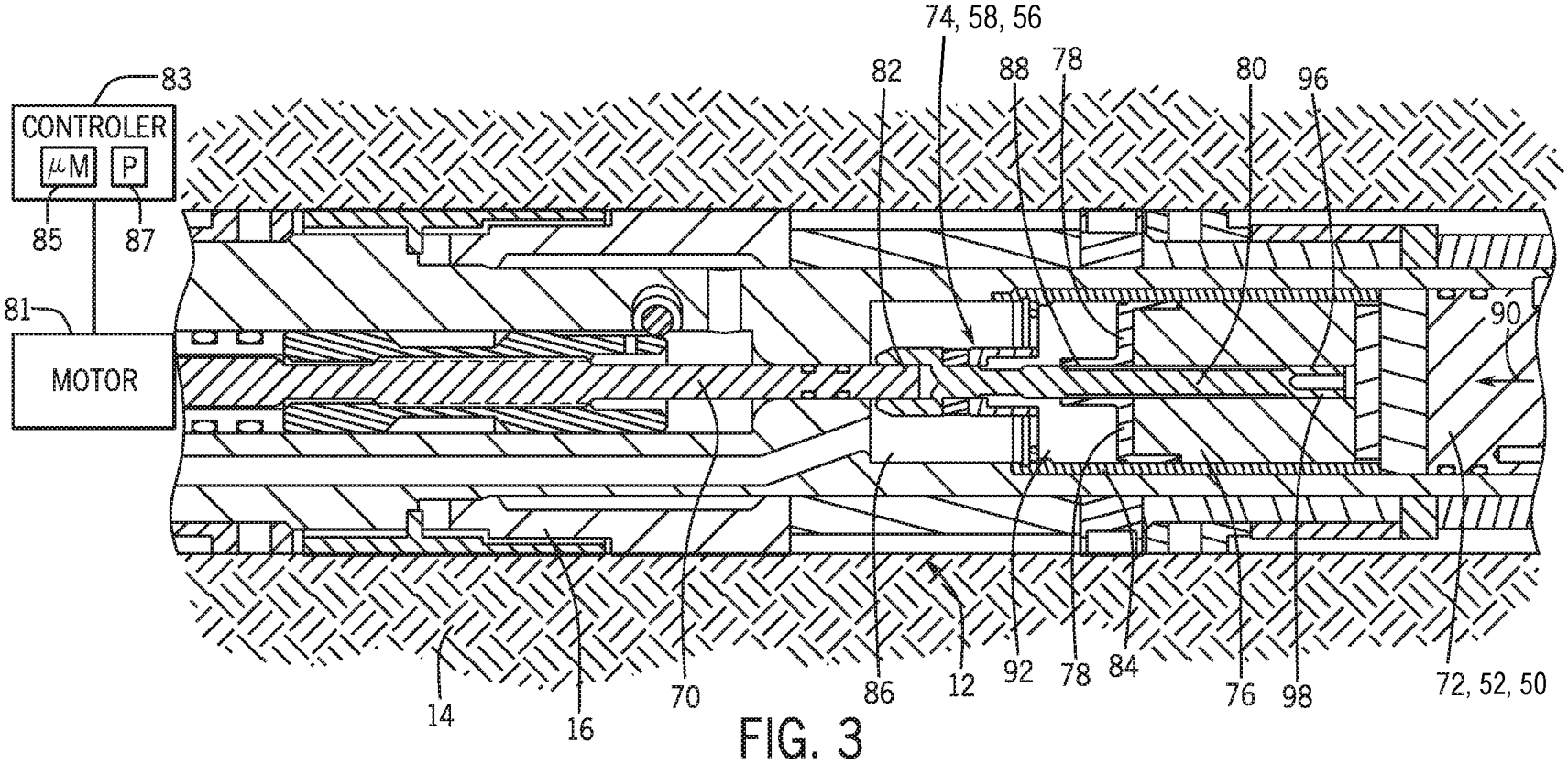
FIG. 3 illustrates the toolstring of FIG. 1 with a driveshaft, a downhole tool, and a release device.

FIG. 3 illustrates the toolstring 12 having a driveshaft 70, a downhole tool 72, which may be first or second downhole tool 50, 52 shown in FIG. 2, and a release device 74, which may be first or second release device 56, 58 shown in FIG. 2. As discussed above, the release device 74, 56, 58 may be used to electrically decouple the downhole tool 72, 50, 52 from the toolstring before mechanically decoupling the downhole tool 72, 50, 52 from the toolstring 12. As such, the release device 74 includes a contact block 76 that receives electricity (e.g., from a wire, conductor, battery, etc.), and electrically couples the release device 74 to the downhole tool 72 (e.g., via electrical pins). The contact block 76 includes a mounting portion 78 that couples the contact block 76 to a rotating shaft 80, which couples to the driveshaft via a rotating joint 82 (e.g., a U-joint).

The release device 74, 56, 58 also includes an outer shell 84, which mechanically couples to the downhole tool 72, 50, 52 and provides a physical barrier between the contact block 76 and an interior 86 of the wellbore 16. The interior 86 of the wellbore 16 contains wellbore fluids, which may include a slurry of different materials (e.g., pumping fluids, particles from the formation 14, etc.). The fluids within the wellbore may conduct electricity, thereby causing an electrical shorting risk if electrical leads come into contact with the wellbore fluids. Accordingly, the outer shell 84 protects the electrical components contained within the release device 74.

The rotating shaft 80 and the mounting portion 78 include threads 88 to enable the contact block 76 to electrically decouple from the downhole tool 72, 50, 52. For example, when releasing the downhole tool 72, the driveshaft 70 may be driven into rotation (e.g., by a motor 81) to cause the rotating shaft 80 to also rotate via the rotating joint 82. The threads 88 of the rotating shaft 80 drive the mounting portion 78 into rotation, and cause the mounting portion 78 and the contact block 76 to move in an upstream direction 90 into a cavity 92 of the release device that is interior to the outer shell 84. As the contact block 76 moves in the upstream direction 90, the contact block 76 electrically decouples from the downhole tool 72. For example, the electric coupling and the downhole tool 72 may be electrically coupled via multiple electrical leads (e.g., conductors, pins, or wires).

The motor 81 (e.g., an electric motor) may be controlled by a motor controller 83. In certain embodiments, the motor controller 83 is an electronic controller having electrical circuitry that may receive a signal indicative of a decoupling procedure. Based at least partly on the signal indicative of the decoupling procedure, the motor controller 83 may direct the motor 81 to rotate the driveshaft 70 to cause electrical and mechanical decoupling of the release device 74, 56, 58 from the downhole tool 72, 50, 52. In the illustrated embodiment, the motor controller 83 includes a processor, such as the illustrated microprocessor 85, and a memory device 87. The motor controller 83 may also include one or more storage devices and/or other suitable components. The microprocessor 85 may be used to execute software, such as software for controlling the motor 81, and so forth. Moreover, the microprocessor 85 may include a single microprocessor, multiple microprocessors, and/or one or more application specific integrated circuits (ASICS), or some combination thereof. For example, the microprocessor 85 may include one or more reduced instruction set (RISC) processors.

The memory device 87 may include a volatile memory, such as random access memory (RAM), and/or a nonvolatile memory, such as read-only memory (ROM). The memory device 87 may store a variety of information and may be used for various purposes. For example, the memory device 87 may store processor-executable instructions (e.g., firmware or software) for the microprocessor 85 to execute, such as instructions for controlling the motor 81. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling the motor 81, etc.), and any other suitable data. Further, the motor controller 83 may be located in any suitable location, such as along the toolstring 12, within or external to the motor 81, at the surface, etc. Further, the motor controller 83 may be part of the data processing system of FIG. 1.

Figure 4:
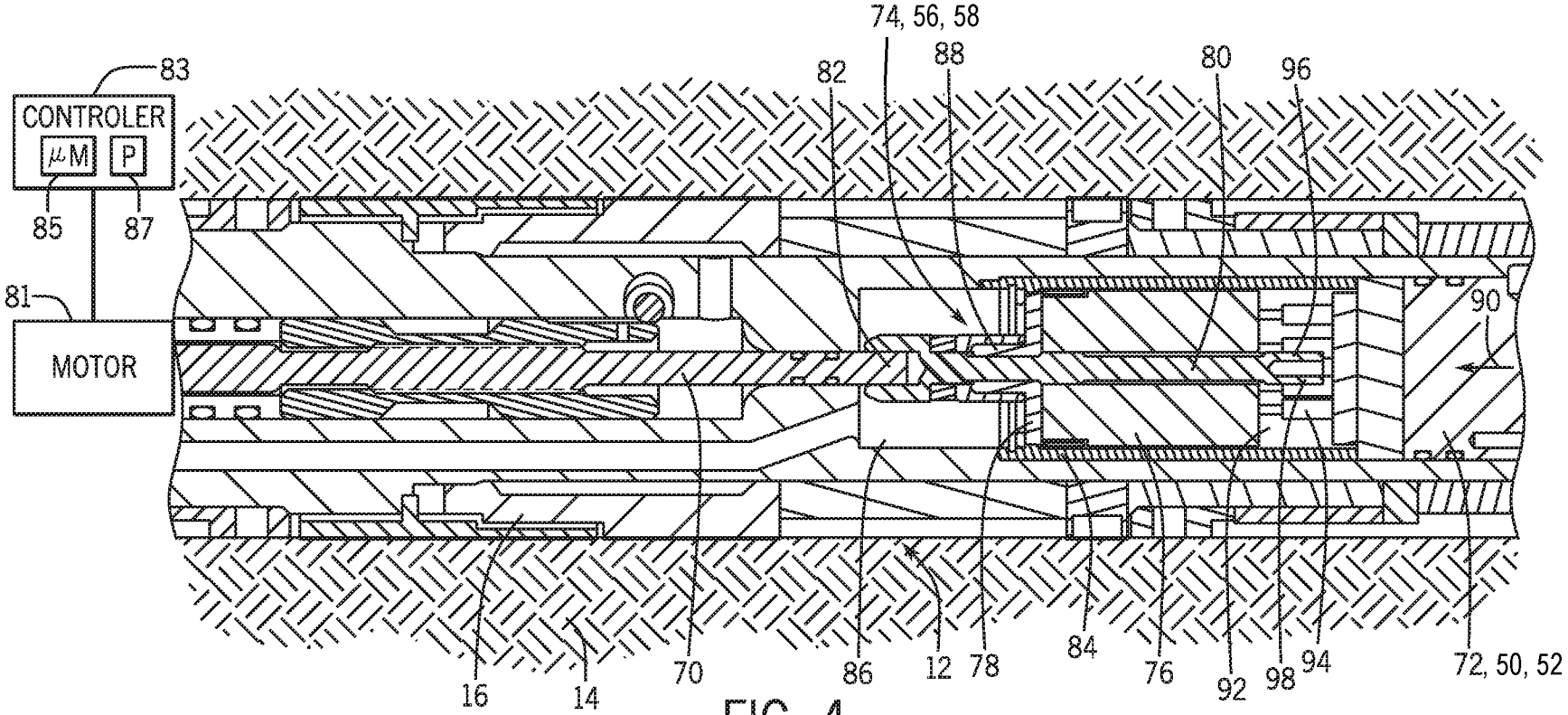
FIG. 4 illustrates a contact block electrically decoupled from the downhole tool of FIG. 3.

FIG. 4 illustrates the contact block 76 electrically decoupled from the downhole tool 72, 50, 52. As discussed above, rotation of the mounting portion 78 may cause the contact block 76 to move in an upstream direction 90. As the contact block 76 moves in the upstream direction 90, the contact block 76 decouples from electric leads 94 (e.g., pins) of the downhole tool 72, 50, 52. Because the entire contact block 76 move in the upstream direction 90 in unison, the contact block 76 may decouple from multiple electric leads 94 at one time. In the present embodiment, the contact block 76 decouples from four electric leads 94 at one time. In some embodiments, the contact block 76 may decouple from any suitable number of electric leads 94, including 1, 2, 3, 5, 6, or more. Further, in the present embodiment, the electric leads 94 have a substantially uniform size in shape. In some embodiments, the electric leads 94 may have varying sizes and shapes. For example, some electric leads may be wider, thinner, longer, shorter, etc. than other electric leads.

After the contact block 76 has been electrically decoupled from the electric leads 94, the release device 74, 56, 58 may be mechanically decoupled from the downhole tool 72, 50, 52. Further, the electric leads 94 may still be within the cavity 92 of the release device, and thus still isolated from the interior 86 of the wellbore 16. In the present embodiment, the rotating shaft 80 includes a screw 96 that enables the release device to mechanically decouple from the downhole tool 72. For example, further rotation of the rotating shaft may cause the screw 96 to rotate about threads 98, thereby driving the rotating shaft 80, and the release device 74 in the upstream direction 90, away from the downhole tool 72. The threads 88 for electric decoupling and the threads 96 for mechanical decoupling may be disposed in opposite directions, which provides a layer of safety, because rotation of the rotating shaft 80 may cause the contact block 76 to rotate in a first direction that may cause the electric decoupling, and rotation of the rotating shaft 80 may cause the outer shell 84 to rotate in a second direction that may cause the mechanical decoupling. The opposite disposition of the threads enables an operator to have a higher degree of confidence that the electric decoupling is completed before beginning the mechanical decoupling. Although the present embodiment illustrates threaded connections and a rotating shaft causing the contact block 76 and the release device 72 to move in the upstream direction 90, it should be appreciated that other mechanical systems may be used to cause the contact block 76, the release device 72, or both to move in the upstream direction 90, such as a piston, a relay, a transistor, a pulley, etc.

In some embodiments, additional mechanical elements may be used to physically isolate the contact block 76, the electric leads 94, or both from the interior 86 of the wellbore 16 before the release device 74, 56, 58 mechanically decouples from the downhole tool 72, 50, 52. For example, one or more covers may extend over the contact block 76, the electric leads 94, or both, such that when the release device 74 mechanically decouples from the downhole tool 72, the contact block 76, the electric leads 94, or both remain in a cavity that is isolated from the interior 86 of the wellbore 16.

Figure 5:
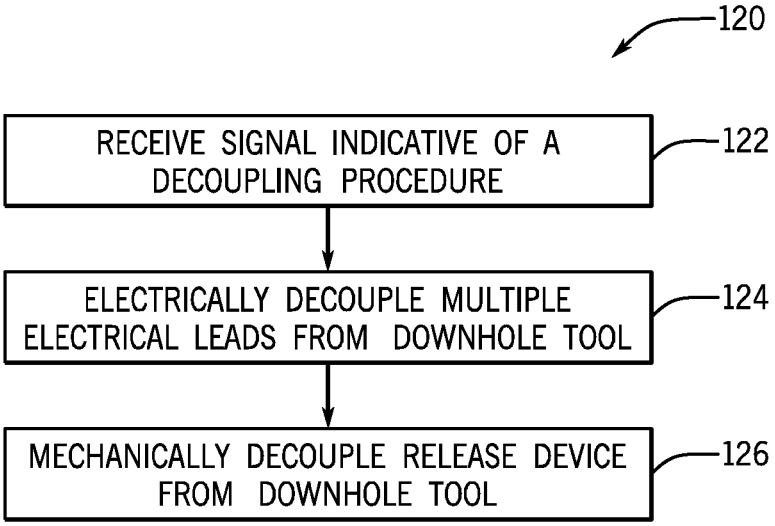
FIG. 5 is a flowchart of an embodiment of a process for electrically and mechanically decoupling the release device of FIG. 3 from the downhole tool of FIG. 3.

FIG. 5 is a flowchart of an embodiment of a process 120 for electrically and mechanically decoupling a release device from a downhole tool. The process 120 enables the release device to decouple multiple electric leads of the downhole tool while maintaining a flow of electricity to other, upstream downhole tools. Although the following process 120 includes a number of operations that may be performed, it should be noted that the process 120 may be performed in a variety of suitable orders (e.g., the order that the operations are discussed, or any other suitable order). All of the operations of the process 120 may not be performed. Further, all of the operations of the process 120 may be performed by the motor controller, the data processing system, an operator, or a combination thereof.

The motor controller may receive (block 122) a signal indicative of a decoupling procedure. The signal may be sent by an operator, or the signal may be sent automatically. For example, a decoupling procedure may be part of a broader operation. As such, once the decoupling procedure part of the broader operation calls is reached, the signal indicative of the decoupling procedure may be sent.

Next, the motor controller causes the motor to drive the driveshaft into rotation, thereby causing the release device to electrically decouple (block 124) the release device from multiple electric leads of the downhole tool. As discussed above, a contact block contained within a cavity of the release device may move in an upstream direction, away from the downhole tool. This movement in the upstream direction may cause the contact block to decouple from multiple electric leads of the downhole tool, thereby electrically decoupling the release device from the downhole tool.

The motor controller causes the motor to drive the driveshaft into rotation, thereby causing the release device to mechanically decouple (block 126) the release device from the downhole tool. In the present embodiment, the motor controller causes the motor to drive the driveshaft, thereby causing the contact block to rotate in a first direction to electrically decouple the release device, and rotation of the driveshaft may also cause the outer shell to rotate in a second direction, opposite the first direction, to mechanically decouple the release device. As the release device is mechanically decoupled from the downhole tool, the electric leads come into contact with the interior of the wellbore, and the wellbore fluids contained within the interior of the wellbore. Because the electric leads have already been electrically decoupled, the contact between the electric leads and the wellbore fluids causes no electric hazards (e.g., electric shorts). As the contact block and electric leads come into contact with the interior of the wellbore, the pressure between the elements is equalized.

With the foregoing in mind, embodiments presented herein provide devices that are capable of electrically and mechanically decoupling from a downhole tool while maintain a flow of electricity through the toolstring. First, a device may electrically decouple from the downhole tool while remaining isolated from the wellbore fluids contained within the interior of the wellbore. Once the device is electrically decoupled, the device may mechanically decouple from the downhole tool. Maintaining a flow of electricity through the toolstring while releasing a downhole tool may reduce the time to pull the toolstring back to the surface, and may enable other downhole tools to continue operating.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A system comprising:

a downhole tool having a plurality of electric leads; and a release device comprising:

an outer shell configured to mechanically couple to the downhole tool, wherein the outer shell is configured to form a cavity that is fluidly separate from wellbore fluids contained within a wellbore while the outer shell is mechanically coupled to the downhole tool; and a contact block configured to electrically couple to the plurality of electric leads, wherein the contact block is configured to electrically decouple from the plurality of electric leads while the outer shell remains mechanically coupled to the downhole tool, and wherein the contact block is configured to remain in the cavity after electrically decoupling from the plurality of electric leads;

wherein rotation of the contact block about a first direction is configured to electrically decouple the contact block from the plurality of electric leads, and rotation of the outer shell about a second direction, opposite of the first direction, is configured to mechanically decouple the outer shell from the downhole tool;

wherein other tools disposed upstream of the release device and the release device are configured to receive electricity before and after electrically and mechanically decoupling from the downhole tool.

2. The system of claim 1, wherein the release device comprises:

a driveshaft coupled to the outer shell and the contact block; and a motor coupled to the driveshaft, wherein the motor is configured to rotate the driveshaft to electrically decouple or mechanically decouple, or both, the release device, from the downhole tool.

3. The system of claim 2, wherein rotation of the driveshaft causes the release device to electrically decouple the contact block from the plurality of electric leads, and rotation of the driveshaft causes the release device to mechanically decouple the outer shell from the downhole tool, or both.

4. The system of claim 2, wherein the contact block comprises a first set of threads threaded along the first direction, and the outer shell comprises a second set of threads threaded along the second direction.

5. The system of claim 1, wherein the downhole tool and the release device are disposed on a wireline toolstring.

6. The system of claim 1, wherein the downhole tool and the release device are disposed on a tractor device, via a coiled tubing, as part of a pump down perforation application, as part of a tough logging conditions operation, as part of a tubing-conveyed perforations operation, or any combination thereof.

7. The system of claim 1, wherein the plurality of electric leads comprises a plurality of pins extending from the downhole tool.

8. A method comprising:

electrically decoupling a contact block of a release device from a plurality of electric leads of a downhole tool while maintaining a fluid separation between the contact block and wellbore fluids contained within a wellbore;

mechanically decoupling an outer shell of the release device after electrically decoupling the contact block from the plurality of electric leads; and maintaining a flow of electricity to the release device and other tools disposed upstream of the release device during both the electrical decoupling and the mechanical decoupling;

wherein rotation of the contact block about a first direction electrically decouples the contact block from the plurality of electric leads, and rotation of the outer shell about a second direction, opposite of the first direction, mechanically decouples the outer shell from the downhole tool.

9. The method of claim 8, wherein rotation of a driveshaft is configured to cause the electric decoupling and the mechanical decoupling.

10. The method of claim 8, wherein the contact block comprises a first set of threads threaded along a first direction, and the outer shell comprises a second set of threads threaded along a second direction, opposite of the first direction.

11. The method of claim 8, wherein the plurality of electric leads comprise a plurality of pins extending from the downhole tool.

12. A system comprising:

a first downhole tool having a first plurality of electric leads;

a first release device comprising:

a first outer shell configured to mechanically couple to the first downhole tool, wherein the first outer shell is configured to form a first cavity that is fluidly separate from wellbore fluids contained within a wellbore while the first outer shell is mechanically coupled to the first downhole tool; and a first contact block configured to electrically couple to the first plurality of electric leads, wherein the first contact block is configured to electrically decouple from the first plurality of electric leads while the first outer shell remains mechanically coupled to the first downhole tool, and wherein the first contact block is configured to remain in the first cavity after electrically decoupling from the first plurality of electric leads;

a second downhole tool having a second plurality of electric leads; and a second release device comprising:

a second outer shell configured to mechanically couple to the second downhole tool, wherein the second outer shell is configured to form a second cavity that is fluidly separate from wellbore fluids contained within the wellbore while the second outer shell is mechanically coupled to the second downhole tool; and a second contact block configured to electrically couple to the second plurality of electric leads, wherein the second contact block is configured to electrically decouple from the second plurality of electric leads while the second outer shell remains mechanically coupled to the second downhole tool, and wherein the second contact block is configured to remain in the second cavity after electrically decoupling from the second plurality of electric leads;

wherein rotation of the first contact block about a first direction is configured to electrically decouple the first contact block from the first plurality of electric leads, and rotation of the first outer shell about a second direction, opposite of the first direction, is configured to mechanically decouple the first outer shell from the first downhole tool;

wherein other tools disposed upstream of the first release device and the first release device are configured to receive electricity before and after electrically and mechanically decoupling from the downhole tool;

wherein other tools disposed upstream of the second release device and the second release device are configured to receive electricity before and after electrically and mechanically decoupling from the downhole tool.

13. The system of claim 12, comprising:

a first driveshaft coupled to the first outer shell and the first contact block;

a first motor coupled to the first driveshaft wherein the first motor is configured to rotate the first driveshaft;

a second driveshaft coupled to the second outer shell and the second contact block; and a second motor coupled to the second driveshaft wherein the second motor is configured to rotate the second driveshaft.

14. The system of claim 13, wherein rotation of the second contact block about a first direction is configured to electrically decouple the second contact block from the second plurality of electric leads, and rotation of the second outer shell about a second direction, opposite of the first direction, is configured to mechanically decouple the second outer shell from the second downhole tool.

15. The system of claim 12, wherein the first plurality of electric leads and the second plurality of electric leads each comprises a respective plurality of pins extending from the respective device.

* * * * *